US006400279B1

(12) United States Patent
Tang

(10) Patent No.: US 6,400,279 B1
(45) Date of Patent: Jun. 4, 2002

(54) DISPLAY UNIT WITH ILLUMINATION

(75) Inventor: Chi-Ceing Tang, Taipei (TW)

(73) Assignee: Lite Vision Corporation, Taipei (TW)

( * ) Notice: Subject to any disclaimer, the term of this patent is extended or adjusted under 35 U.S.C. 154(b) by 123 days.

(21) Appl. No.: 09/628,413

(22) Filed: Jul. 28, 2000

(51) Int. Cl.[7] ..... G09F 13/00; G08B 5/00

(52) U.S. Cl. ..... 340/815.4; 340/815.47; 340/815.49; 340/815.58; 40/431; 40/564; 345/4; 345/905

(58) Field of Search ..... 340/815.4, 815.47, 340/815.49, 815.58, 815.86, 525, 321; 40/430, 431, 470, 564; 345/4, 5, 903, 905

(56) References Cited

U.S. PATENT DOCUMENTS

| | | | | | |
|---|---|---|---|---|---|
| 3,806,722 | A | * | 4/1974 | Peake et al. | 40/130 |
| 4,092,791 | A | * | 6/1978 | Apissomian | 40/470 |
| 4,983,031 | A | * | 1/1991 | Solomon | 353/10 |
| 5,513,084 | A | * | 4/1996 | Simpson | 362/284 |

* cited by examiner

*Primary Examiner*—Donnie L. Crosland
(74) *Attorney, Agent, or Firm*—Fei-Fei Chao; Venable, Baetjer, Howard & Civiletti, LLP

(57) ABSTRACT

A display unit has multiple illuminators provided in a housing of the unit. The display unit has a right prism composed of at least four side faces each with a unique color and being detachably connected with a step motor. The display unit is able to provide the necessary brightness by means of the illuminators when the ambient light is not sufficient.

2 Claims, 4 Drawing Sheets

DISPLAY UNIT WITH ILLUMINATION

BACKGROUND OF THE INVENTION

1. Field of the Invention

The present invention relates to a display unit, and more particularly to a display unit with illumination. The display unit has a housing with a right prism rotatably received therein and having at least four different colors individually applied to outer faces of the right prism. Multiple illuminators are provided on the housing, such that the display unit is able to illuminate itself to clearly show the picture presented by groups of display units when ambient light is not sufficient.

2. Description of Related Art

"TV walls" used to show commercial products or live broadcast of concerts or the like are very popular in the market. However, the cost to build and operate a "TV wall" makes it unaffordable to most merchants. A less expensive alternative to the "TV wall" for presenting commercial products is a series of display units. Using display units commercially is effective and economic, because they primarily consists of step motors controlled by a computer program.

With reference to FIG. 4, conventional display units, each with different colors, are grouped by pictures programmed to be presented. This type of display unit has a base (10), a housing (40), a step motor (20), a right prism (30) and colored sticker (31) for each face of the right prism (30). The housing (40) covers the step motor (20) that is securely mounted on the base (10). The right prism (30) is detachably mounted on the step motor (20). Each sticker (31) has a different color and is glued to an outer face of the right prism (30). Multiple display units are grouped in a desired configuration with the step motor (20) in each display unit controlled by a computer program. The computer program rotates each step motor (20) to present the desired color such that the overall configuration of display units presents a predetermined picture by showing various combinations of colors. However, this kind of display unit has several disadvantages.

Users have to glue color stickers (31) individually on the outer faces of the right prism (30), which is quite labor intensive and costly. Furthermore, during the night, the groups of display units need extra lighting equipment to present the picture, which is an additional economic burden to the user.

To overcome the shortcomings, the present invention tends to provide an improved display unit with illumination to mitigate and obviate the aforementioned problems.

SUMMARY OF THE INVENTION

The main objective of the invention is to provide an improved display unit having a right prism detachably connected to the step motor and multiple illuminating devices mounted on the housing, such that the display unit is still able to present the picture even when the ambient light is not bright enough.

Other objects, advantages and novel features of the invention will become more apparent from the following detailed description when taken in conjunction with the accompanying drawings.

DETAILED DESCRIPTION OF PREFERRED EMBODIMENT

Figure 1:
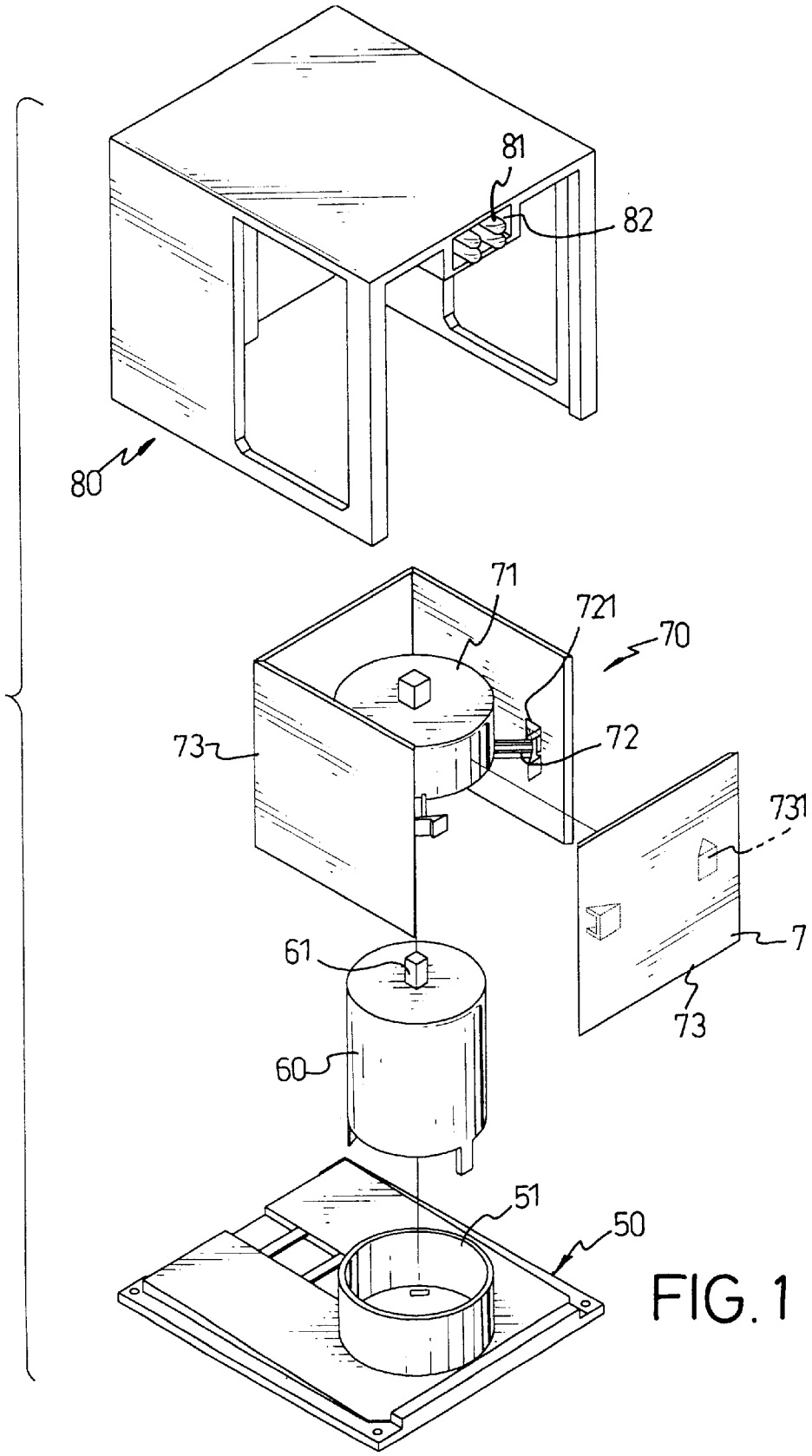
FIG. 1 is an exploded perspective view of the display unit in accordance with the present invention.

With reference to FIG. 1, a display unit in accordance with the present invention has a base (50), a step motor (60), a right prism (70) and a housing (80).

An annular flange (51) is securely formed on the top face of the base (50) to rigidly receive the step motor (60). A rotatable shaft (61) extends out of the top of the step motor (60).

The right prism (70) is composed of a cap (71), multiple connecting rods (72) and a side faces (73). The connecting rods (72) integrally extending out from the outer periphery of the cap (71). Each side face (73) is detachably connected to the connecting rods (73).

Multiple illuminators (81) are received in a compartment (82) defined in the housing (80).

Figure 2:
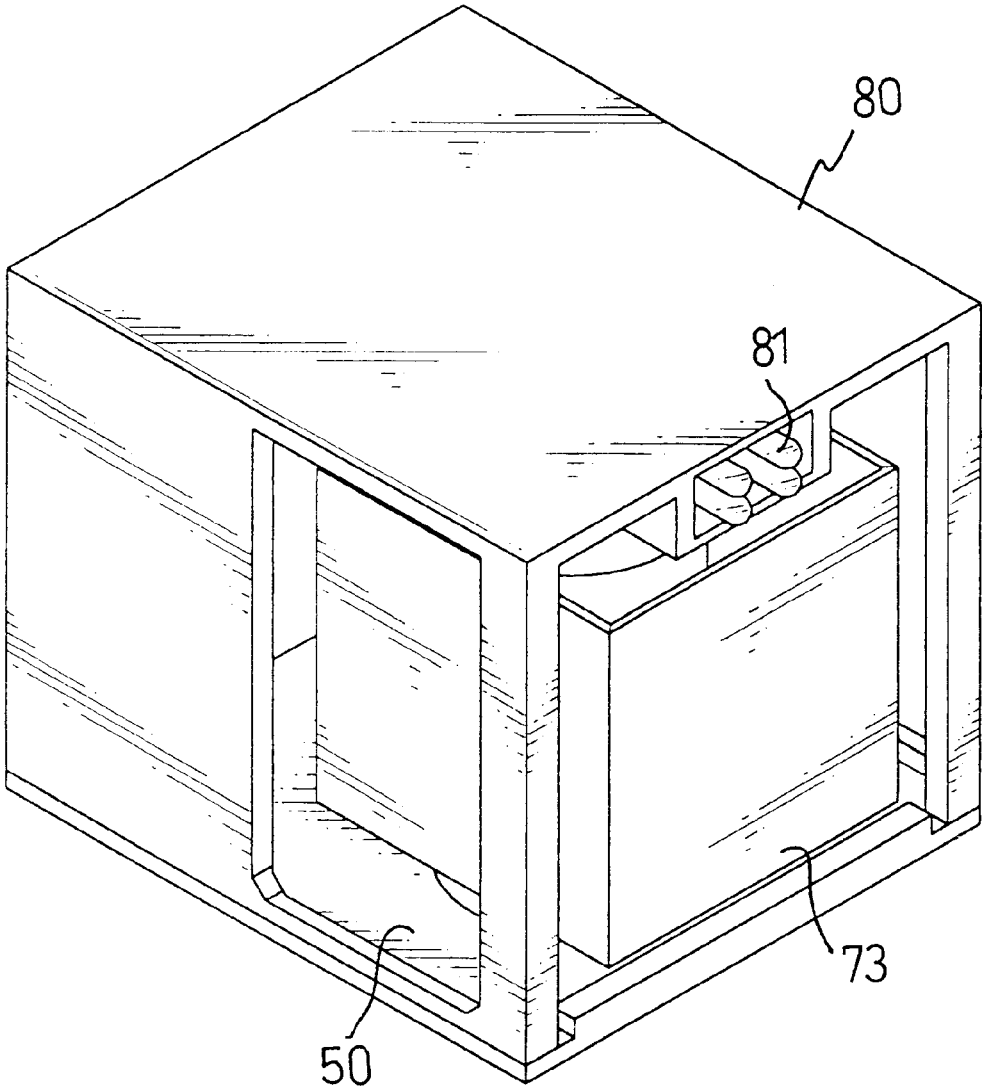
FIG. 2 is a perspective view of the display unit in FIG. 1.

During the assembly of the display unit, the step motor (60) is securely mounted in the annular flange (51). Then, the cap (71) together with the side faces (73) is securely yet detachably engaged with the shaft (61) of the step motor (60). Each of the side faces (73) is mounted between two other side faces (73). The distal end of each of the connecting rods (72) is provided with a pair of opposed wedged blocks (721) formed to correspond to the pair of opposed seats (731) formed on the inner face of each side face (73). With the corresponding relationship between the seats (731) and the wedged blocks (721) on the distal ends of the connecting rods (72), each side face (73) of the right prism (70) is able to be detachably connected to the cap (71). Therefore, when the cap (71) is placed on top of the step motor (60), the side faces (73) of the right prism (70) enclose the step motor (60). Then, the housing (80) is securely mounted on top of the base (50) to cover the right prism (70) and the step motor (60), which completes the assembly of a single display unit, as shown in FIG. 2.

Figure 3:
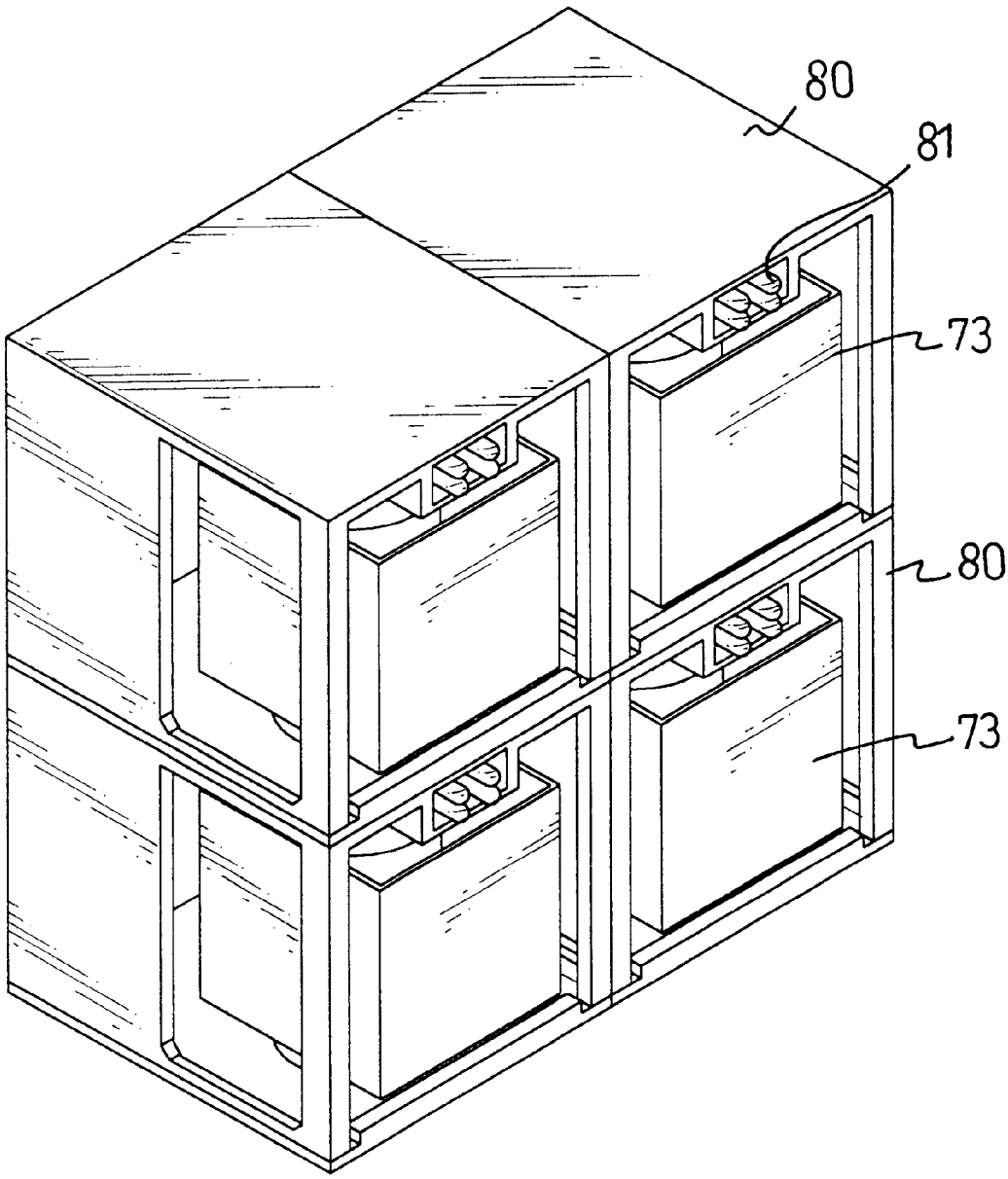
FIG. 3 is a perspective view of a group of display units forming a screen.
Figure 4:
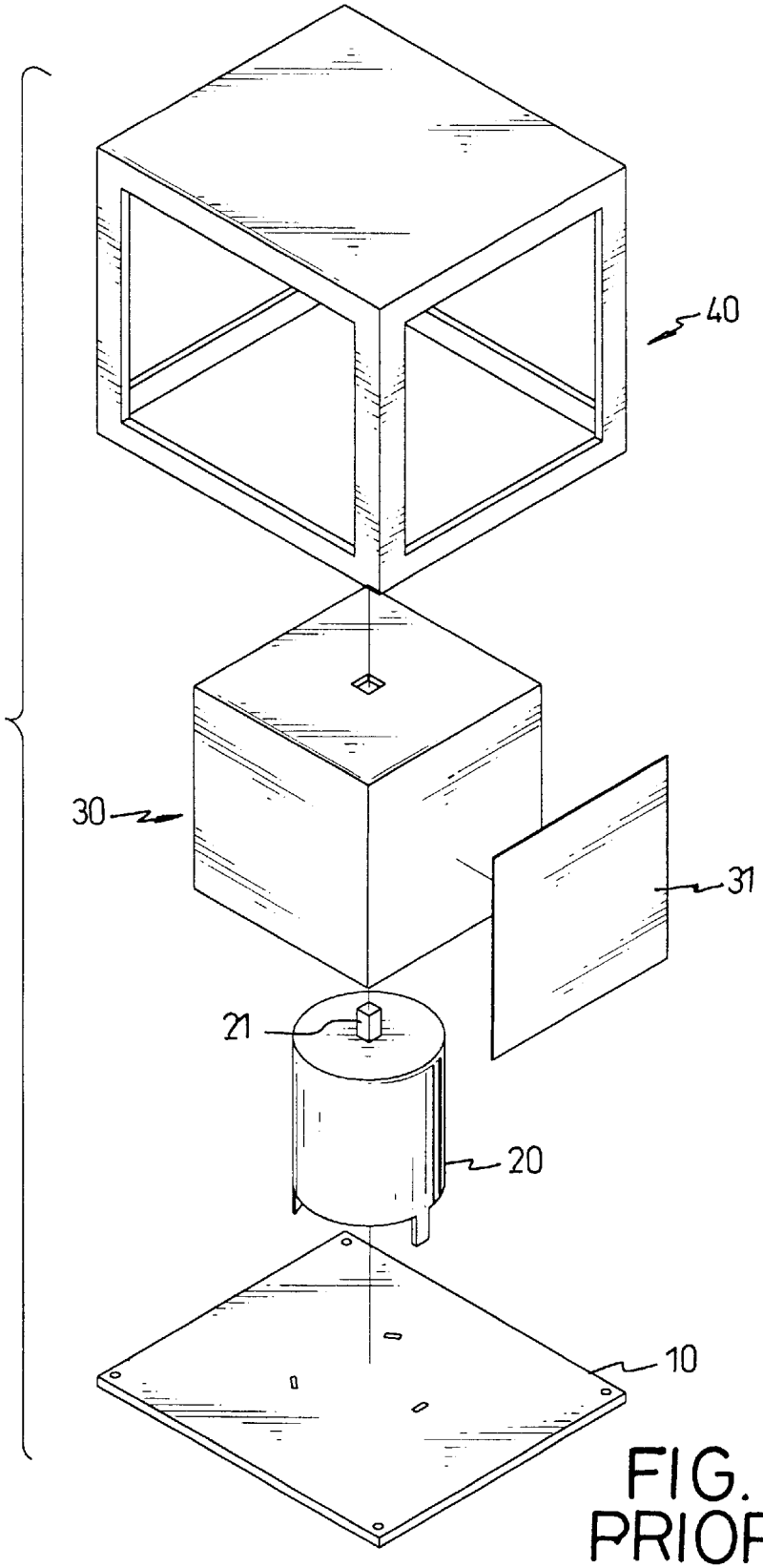
FIG. 4 PRIOR ART
FIG. 4 is an exploded perspective view of a conventional display unit.

With reference to FIG. 3, multiple display units are assembled to show a predetermined picture. With the individual side faces (73) of the right prism (70) being different colors, such as red, blue, green and white, the assembled display units are able to show a picture by means of the control of a computer program. Furthermore, due to the multiple illuminators (81) in the compartment (82), each of the display units is able to provide necessary illumination to illuminate a specific side face (73). As a consequence to the illuminators (81), the display unit still is able to clearly to show the color of the side face (73) even when the ambient light is not sufficient.

The display device in accordance with the present invention has the following advantages:

1. reduced cost:

Because the color of the side face (73) is pre-formed, no manual work is necessary to glue the colored sticker onto the side face, which dramatically reduces the fabrication cost.

2. easy replacement of the side face

Because the side faces (73) are detachably connected with outer periphery of the cap (71) by means of the connecting rods (72), it is quite easy for the user to replace a side face (73) when a side face (73) of another color is required.

3. self illumination

The illuminators (81) mounted on the housing (80) provides necessary brightness to the side face (73) when the ambient light is not sufficient. Therefore, the display unit is still able to present the picture designed to be revealed to the public at night or in dark locations.

It is to be understood, however, that even though numerous characteristics and advantages of the present invention have been set forth in the foregoing description, together with details of the structure and function of the invention, the disclosure is illustrative only, and changes-may be made in detail, especially in matters of shape, size, and arrangement of parts within the principles of the invention to the full extent indicated by the broad general meaning of the terms in which the appended claims are expressed.

What is claimed is:

1. A display unit having a base, a step motor securely mounted on the base, a right prism detachably engaged with the step motor and a housing securely engaged with the base to enclose the right prism and the step motor, wherein the improvements comprise:

the base having an annular flange formed to receive the step motor;

the right prism having a cap detachably engaged with the step motor, multiple connecting rods each integrally formed on an outer periphery of the cap to detachably engage a side face; and multiple illuminators provided in a compartment in the housing.

2. The display unit as claimed in claim 1, wherein each distal end of the connecting rods has a pair of opposed wedged blocks formed to correspond to a pair of opposed seats that are formed on an inner face of each of the side faces.

* * * * *